US005887903A

United States Patent [19]

Schreadley, Jr.

[11] Patent Number: 5,887,903

[45] Date of Patent: Mar. 30, 1999

[54] COMBINED SERVICE CHECK AND TIPPING GUIDE AND METHOD OF USE

[76] Inventor: John E. Schreadley, Jr., P.O. Box 84, Dunedin, Fla. 34697-0084

[21] Appl. No.: 939,373

[22] Filed: Sep. 29, 1997

[51] Int. Cl.[6] ..... B42D 15/00

[52] U.S. Cl. ..... 283/60.2; 283/60.1; 283/66.1; 283/115

[58] Field of Search ..... 283/44, 48.1, 57, 283/58, 60.1, 115, 60.2, 66.1

[56] References Cited

U.S. PATENT DOCUMENTS

| | | | |
|---|---|---|---|
| 409,877 | 8/1889 | Smith . | |
| 447,856 | 3/1891 | Will . | |
| 739,964 | 9/1903 | White et al. | 283/60.1 |
| 1,466,444 | 8/1923 | Brower | 283/115 |
| 1,557,613 | 10/1925 | Raschick | 283/60.1 |
| 4,251,093 | 2/1981 | Tobin | 283/44 |
| 4,526,403 | 7/1985 | Park | 283/105 |
| 4,723,794 | 2/1988 | Shannon | 283/60.2 |

*Primary Examiner*—Willmon Fridie, Jr.
*Attorney, Agent, or Firm*—Dennis G. LaPointe

[57] ABSTRACT

A combined service check and tipping guide and method of providing a combined service check and tipping guide to a customer is described. The method includes either printing a check to bill a customer for a specific monetary amount for services rendered for which a tip is anticipated and then integrating a tipping guide comprised of a numeric table delineating the amount of a tip as a percentage of an amount owed in a predetermined range prior to the specific amount of the bill being printed on the check; or integrating the check and the tipping guide together; both prior to providing the check with integrated tipping guide to the customer.

12 Claims, 4 Drawing Sheets

| Bill | 15% | 17% | 20% | Bill | 15% | 17% | 20% |
|---|---|---|---|---|---|---|---|
| $1.00 | $.15 | $.17 | $.20 | $51.00 | $7.60 | $8.70 | $10.20 |
| 2.00 | .30 | .35 | .40 | 52.00 | 7.80 | 8.80 | 10.40 |
| 4.00 | .60 | .70 | .80 | 54.00 | 8.10 | 9.20 | 10.80 |
| 6.00 | .90 | 1.00 | 1.20 | 56.00 | 8.40 | 9.50 | 11.20 |
| 8.00 | 1.20 | 1.40 | 1.60 | 58.00 | 8.70 | 9.90 | 11.60 |
| 10.00 | 1.50 | 1.70 | 2.00 | 60.00 | 9.00 | 10.20 | 12.00 |
| 12.00 | 1.80 | 2.00 | 2.40 | 62.00 | 9.30 | 10.50 | 12.40 |
| 14.00 | 2.10 | 2.40 | 2.80 | 64.00 | 9.60 | 10.90 | 12.80 |
| 16.00 | 2.40 | 2.70 | 3.20 | 66.00 | 9.90 | 11.20 | 13.20 |
| 18.00 | 2.70 | 3.10 | 3.60 | 68.00 | 10.20 | 11.60 | 13.60 |
| 20.00 | 3.00 | 3.40 | 4.00 | 70.00 | 10.50 | 11.90 | 14.00 |
| 22.00 | 3.30 | 3.70 | 4.40 | 72.00 | 10.80 | 12.20 | 14.40 |
| 24.00 | 3.60 | 4.10 | 4.80 | 74.00 | 11.10 | 12.60 | 14.80 |
| 26.00 | 3.90 | 4.40 | 5.20 | 76.00 | 11.40 | 12.90 | 15.20 |
| 28.00 | 4.20 | 4.80 | 5.60 | 78.00 | 11.70 | 13.30 | 15.60 |
| 30.00 | 4.50 | 5.10 | 6.00 | 80.00 | 12.00 | 13.60 | 16.00 |
| 32.00 | 4.80 | 5.40 | 6.40 | 82.00 | 12.30 | 13.90 | 16.40 |
| 34.00 | 5.10 | 5.80 | 6.80 | 84.00 | 12.60 | 14.30 | 16.80 |
| 36.00 | 5.40 | 6.10 | 7.20 | 86.00 | 12.90 | 14.60 | 17.20 |
| 38.00 | 5.70 | 6.50 | 7.60 | 88.00 | 13.20 | 15.00 | 17.60 |
| 40.00 | 6.00 | 6.80 | 8.00 | 90.00 | 13.50 | 15.30 | 18.00 |
| 42.00 | 6.30 | 7.10 | 8.40 | 92.00 | 13.80 | 15.60 | 18.40 |
| 44.00 | 6.60 | 7.50 | 8.80 | 94.00 | 14.10 | 16.00 | 18.80 |
| 46.00 | 6.90 | 7.80 | 9.20 | 96.00 | 14.40 | 16.30 | 19.20 |
| 48.00 | 7.20 | 8.20 | 9.60 | 98.00 | 14.70 | 16.70 | 19.60 |
| 50.00 | 7.50 | 8.50 | 10.00 | 100.00 | 15.00 | 17.00 | 20.00 |

Seventeen percent figures have been rounded to the nearest five or ten cents.

| Bill | 15% | 17% | 20% | Bill | 15% | 17% | 20% |
|---|---|---|---|---|---|---|---|
| $1.00 | $.15 | $.17 | $.20 | $51.00 | $7.60 | $8.70 | $10.20 |
| 2.00 | .30 | .35 | .40 | 52.00 | 7.80 | 8.80 | 10.40 |
| 4.00 | .60 | .70 | .80 | 54.00 | 8.10 | 9.20 | 10.80 |
| 6.00 | .90 | 1.00 | 1.20 | 56.00 | 8.40 | 9.50 | 11.20 |
| 8.00 | 1.20 | 1.40 | 1.60 | 58.00 | 8.70 | 9.90 | 11.60 |
| 10.00 | 1.50 | 1.70 | 2.00 | 60.00 | 9.00 | 10.20 | 12.00 |
| 12.00 | 1.80 | 2.00 | 2.40 | 62.00 | 9.30 | 10.50 | 12.40 |
| 14.00 | 2.10 | 2.40 | 2.80 | 64.00 | 9.60 | 10.90 | 12.80 |
| 16.00 | 2 40 | 2.70 | 3.20 | 66.00 | 9.90 | 11.20 | 13.20 |
| 18.00 | 2 70 | 3.10 | 3 60 | 68.00 | 10.20 | 11.60 | 13.60 |
| 20.00 | 3.00 | 3.40 | 4.00 | 70.00 | 10.50 | 11.90 | 14.00 |
| 22.00 | 3.30 | 3.70 | 4.40 | 72.00 | 10.80 | 12.20 | 14.40 |
| 24.00 | 3.60 | 4.10 | 4.80 | 74.00 | 11.10 | 12.60 | 14.80 |
| 26.00 | 3.90 | 4.40 | 5.20 | 76.00 | 11.40 | 12.90 | 15.20 |
| 28.00 | 4.20 | 4.80 | 5.60 | 78.00 | 11.70 | 13.30 | 15.60 |
| 30.00 | 4.50 | 5.10 | 6.00 | 80.00 | 12.00 | 13.60 | 16.00 |
| 32.00 | 4.80 | 5.40 | 6.40 | 82.00 | 12.30 | 13.90 | 16.40 |
| 34.00 | 5.10 | 5.80 | 6.80 | 84.00 | 12.60 | 14.30 | 16.80 |
| 36.00 | 5.40 | 6.10 | 7.20 | 86.00 | 12.90 | 14.60 | 17.20 |
| 38.00 | 5.70 | 6.50 | 7.60 | 88.00 | 13.20 | 15.00 | 17.60 |
| 40.00 | 6.00 | 6.80 | 8 00 | 90.00 | 13.50 | 15 30 | 18.00 |
| 42.00 | 6.30 | 7.10 | 8.40 | 92.00 | 13.80 | 15.60 | 18.40 |
| 44.00 | 6.60 | 7.50 | 8.80 | 94.00 | 14.10 | 16.00 | 18 80 |
| 46.00 | 6.90 | 7.80 | 9.20 | 96.00 | 14.40 | 16.30 | 19.20 |
| 48.00 | 7.20 | 8.20 | 9.60 | 98.00 | 14.70 | 16.70 | 19.60 |
| 50.00 | 7.50 | 8.50 | 10.00 | 100.00 | 15.00 | 17.00 | 20.00 |

Seventeen percent figures have been rounded to the nearest five or ten cents.

| | | | | | | | |
|---|---|---|---|---|---|---|---|
| 26.00 | 3.90 | 4.40 | 5.20 | 76.00 | 11 40 | 12 90 | 15.20 |
| 28.00 | 4 20 | 4.80 | 5.60 | 78.00 | 11 70 | 13.30 | 15.60 |
| 30.00 | 4.50 | 5.10 | 6.00 | 80.00 | 12 00 | 13 60 | 16.00 |
| 32.00 | 4.80 | 5.40 | 6.40 | 82.00 | 12.30 | 13.90 | 16.40 |
| 34.00 | 5.10 | 5.80 | 6.80 | 84.00 | 12.60 | 14.30 | 16.80 |
| 36.00 | 5.40 | 6.10 | 7.20 | 86.00 | 12.90 | 14 60 | 17.20 |
| 38.00 | 5.70 | 6 50 | 7.60 | 88.00 | 13 20 | 15.00 | 17.60 |
| 40.00 | 6.00 | 6.80 | 8.00 | 90.00 | 13.50 | 15.30 | 18.00 |
| 42.00 | 6.30 | 7.10 | 8.40 | 92.00 | 13.80 | 15.60 | 18.40 |
| 44.00 | 6.60 | 7.50 | 8.80 | 94.00 | 14.10 | 16.00 | 18.80 |
| 46.00 | 6.90 | 7.80 | 9.20 | 96.00 | 14.40 | 16.30 | 19.20 |
| 48.00 | 7.20 | 8.20 | 9.60 | 98.00 | 14.70 | 16.70 | 19.60 |
| 50.00 | 7.50 | 8.50 | 10.00 | 100.00 | 15.00 | 17.00 | 20.00 |

Seventeen percent figures have been rounded to the nearest five or ten cents.

18

A GUIDE TO TIPPING

20

For your convenience you may consider referring to the chart below. It is designed solely for assisting you in quickly calculating a tip and is in no way meant to influence your usual method of tipping.

22

24

28

| Bill | 15% | 17% | 20% | Bill | 15% | 17% | 20% |
|---|---|---|---|---|---|---|---|
| $1.00 | $.15 | $.17 | $ 20 | $51.00 | $7.60 | $8.70 | $10.20 |
| 2.00 | .30 | .35 | 40 | 52.00 | 7.80 | 8.80 | 10.40 |
| 4.00 | .60 | .70 | .80 | 54.00 | 8 10 | 9 20 | 10.80 |
| 6.00 | .90 | 1.00 | 1.20 | 56.00 | 8.40 | 9.50 | 11.20 |
| 8.00 | 1.20 | 1.40 | 1.60 | 58.00 | 8.70 | 9.90 | 11.60 |
| 10.00 | 1.50 | 1.70 | 2.00 | 60.00 | 9.00 | 10.20 | 12.00 |
| 12.00 | 1.80 | 2.00 | 2.40 | 62.00 | 9.30 | 10.50 | 12.40 |
| 14.00 | 2.10 | 2.40 | 2.80 | 64.00 | 9.60 | 10.90 | 12.80 |
| 16.00 | 2.40 | 2.70 | 3.20 | 66.00 | 9.90 | 11.20 | 13.20 |
| 18.00 | 2.70 | 3.10 | 3.60 | 68.00 | 10.20 | 11.60 | 13.60 |
| 20.00 | 3.00 | 3.40 | 4.00 | 70.00 | 10.50 | 11.90 | 14.00 |
| 22.00 | 3.30 | 3.70 | 4.40 | 72.00 | 10.80 | 12.20 | 14.40 |
| 24.00 | 3.60 | 4.10 | 4.80 | 74.00 | 11.10 | 12.60 | 14.80 |
| 26.00 | 3.90 | 4.40 | 5.20 | 76.00 | 11.40 | 12.90 | 15.20 |
| 28.00 | 4.20 | 4.80 | 5.60 | 78.00 | 11.70 | 13.30 | 15.60 |
| 30.00 | 4.50 | 5.10 | 6.00 | 80.00 | 12.00 | 13 60 | 16.00 |
| 32.00 | 4.80 | 5.40 | 6.40 | 82.00 | 12.30 | 13.90 | 16.40 |
| 34.00 | 5.10 | 5.80 | 6.80 | 84.00 | 12.60 | 14.30 | 16.80 |
| 36.00 | 5.40 | 6.10 | 7.20 | 86.00 | 12.90 | 14.60 | 17.20 |
| 38.00 | 5.70 | 6.50 | 7.60 | 88.00 | 13.20 | 15.00 | 17.60 |
| 40.00 | 6.00 | 6.80 | 8.00 | 90.00 | 13.50 | 15.30 | 18.00 |
| 42.00 | 6.30 | 7.10 | 8.40 | 92.00 | 13.80 | 15.60 | 18.40 |
| 44.00 | 6.60 | 7.50 | 8.80 | 94.00 | 14.10 | 16.00 | 18.80 |
| 46.00 | 6.90 | 7.80 | 9.20 | 96.00 | 14 40 | 16 30 | 19.20 |
| 48.00 | 7.20 | 8.20 | 9.60 | 98.00 | 14.70 | 16.70 | 19.60 |
| 50.00 | 7.50 | 8.50 | 10.00 | 100.00 | 15.00 | 17 00 | 20.00 |

Seventeen percent figures have been rounded to the nearest five or ten cents.

26

30

A GUIDE TO TIPPING

For your convenience you may consider referring to the chart below. It is designed solely for assisting you in quickly calculating a tip and is in no way meant to influence your usual method of tipping.

| Bill | 15% | 17% | 20% | Bill | 15% | 17% | 20% |
|---|---|---|---|---|---|---|---|
| $1.00 | $.15 | $.17 | $.20 | $51.00 | $7.60 | $8.70 | $10.20 |
| 2.00 | .30 | .35 | .40 | 52.00 | 7 80 | 8.80 | 10.40 |
| 4.00 | .60 | .70 | .80 | 54.00 | 8.10 | 9.20 | 10 80 |
| 6.00 | .90 | 1.00 | 1.20 | 56.00 | 8.40 | 9.50 | 11.20 |
| 8.00 | 1.20 | 1.40 | 1.60 | 58.00 | 8.70 | 9.90 | 11.60 |
| 10.00 | 1.50 | 1.70 | 2.00 | 60.00 | 9.00 | 10.20 | 12.00 |
| 12.00 | 1.80 | 2.00 | 2.40 | 62.00 | 9.30 | 10.50 | 12.40 |
| 14.00 | 2.10 | 2.40 | 2.80 | 64.00 | 9.60 | 10.90 | 12.80 |
| 16.00 | 2.40 | 2 70 | 3.20 | 66.00 | 9.90 | 11.20 | 13.20 |

*Fig. 4*

COMBINED SERVICE CHECK AND TIPPING GUIDE AND METHOD OF USE

BACKGROUND OF THE INVENTION

1. Field of the Invention

The present invention relates to a combined service check and tipping guide and method of providing a combined service check and tipping guide to a customer for services rendered for which a tip is anticipated.

2. Description of the Related Art

The prior art as is best known to the inventor includes devices and methods for integrating various graphics and coupons with service checks. A typical example of the prior art is U.S. Pat. No. 4,526,403 to Park, which teaches a method of providing a combined calculator tape and coupon. The Park method either integrates a roll of an adhesive coupon strip onto the back of a roll of calculator tape as a checkout bill is being printed on the front of the tape, or actually prints the coupon on the back of the tape. Park's method does not provide any assistance to the customer is determining the amount of a tip or gratuity to leave for the services rendered.

Other preprinted restaurant checks which include various charts and graphics are known in the art, such as U.S. Pat. No. 1,557,613 to Raschick, U.S. Pat. No. 739,964 to White, et al., and U.S. Pat. No. 409,877 to Smith. However, those patents do not disclose or suggest the inclusion of a tipping guide with the check for assisting a customer with calculation of the tip.

SUMMARY OF THE INVENTION

The present invention is a combined service check and tipping guide and method of providing a combined service check and tipping guide to a customer, comprised of either printing a check to bill a customer for a specific monetary amount for services rendered for which a tip is anticipated and then integrating a tipping guide comprised of a numeric table delineating the amount of a tip as a percentage of an amount owed in a predetermined range onto the check; or integrating the tipping guide onto a preprinted check prior to the specific amount of the bill being printed on the check portion; or integrating the check and the tipping guide together; and providing the check and integrated tipping guide to the customer.

The primary object of the present invention is therefore to provide a customer receiving a bill for services rendered a tipping guide on the bill whereby the customer will not have to mathematically calculate the amount of the tip.

The above and yet further objects and advantages of the present invention will become apparent from the hereinafter set forth Brief Description of the Drawings and Detailed Description of the Invention.

BRIEF DESCRIPTION OF THE DRAWINGS

FIG. 4 is a full view of the tipping guide on the back of the roll tape of FIG. 3.

DETAILED DESCRIPTION OF THE INVENTION

Figure 1:
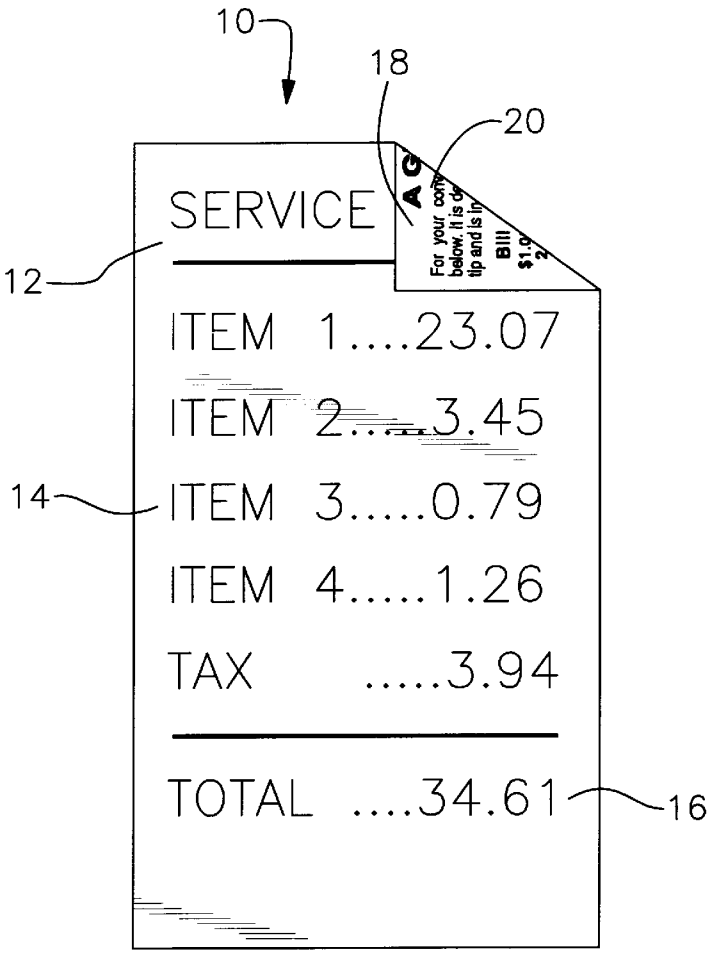
FIG. 1 is a front view of the service check with a folded corner revealing the tipping guide on the back.

The present invention is a combined service check and tipping guide and method of providing a combined service check and tipping guide 10, which is particularly useful for restaurants. The check and guide 10 is embodied in FIG. 1 with the check portion 14 on the front 12 of the check and guide 10. A total amount 16 for services rendered is displayed, although, here, the check portion 14 is itemized to provide the total 16. The check portion 14, and indeed the entire front of the check and guide 10 could be blank such that a user can print an entire check portion 14. Alternatively, preprinted writing may exist and a user may need only to print, either mechanically or manually, the actual total 16.

Figure 2:
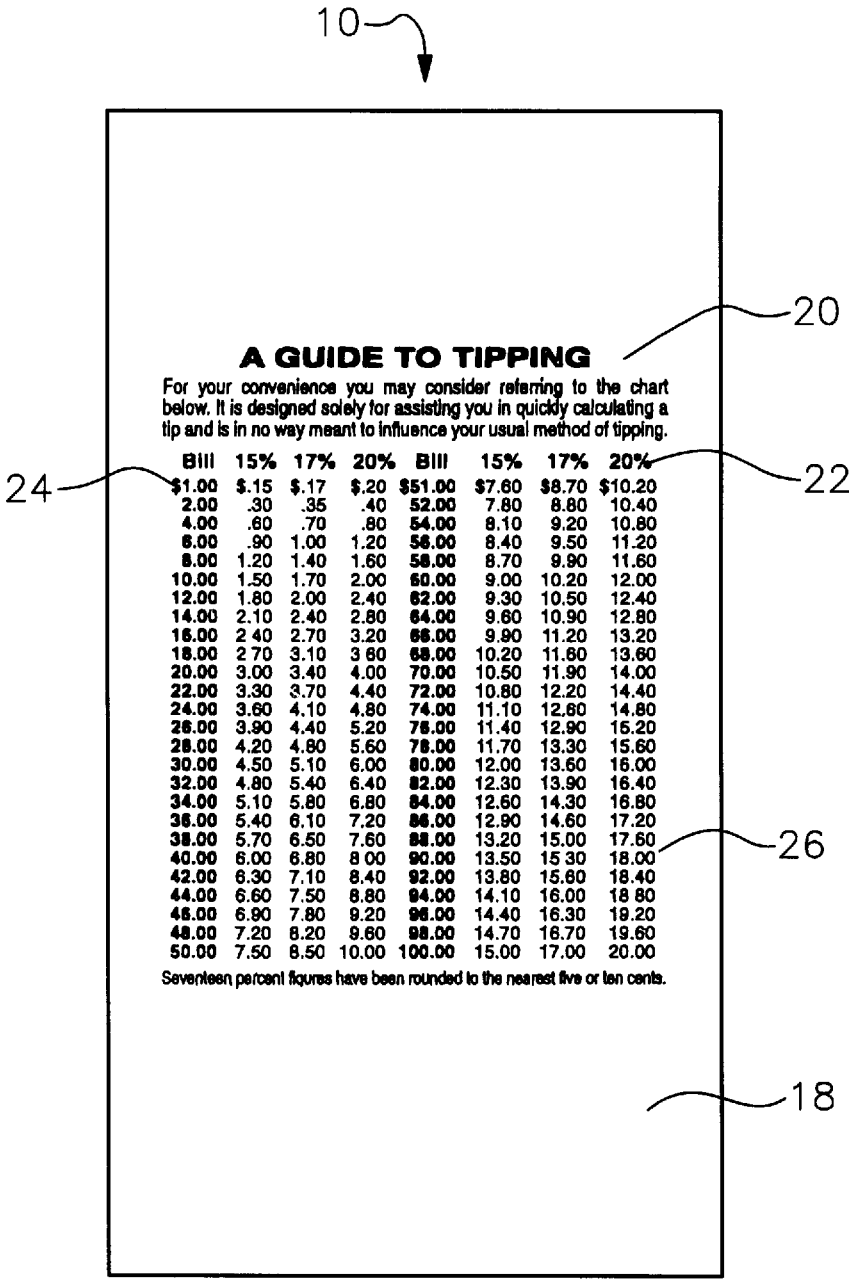
FIG. 2 is a full view of the tipping guide on the back of the service check of FIG. 1.

The tipping guide 20, partially shown in FIG. 1, is specifically shown in FIG. 2 as integrated onto the back 18 of the check and guide 10. As shown in FIG. 2, the tipping guide 20 is essentially comprised of a numerical table displaying the amount of a tip 26 as a percentage 22 of the bill amount 24. The numerical table is comprised of a predetermined range of bill amounts preferably in the range of possible amount totals for the establishment that uses the check and guide 10. It is suggested that the table be divided into $2.00 increments, however, the increments of the tipping guide 20 may be either further divided or increased depending on preference and the printing limitations due to the actual size of the check and guide 10. Tipping includes any form of gratuity given by a customer on return for services and is an amount, usually money, which is based upon a predetermined percentage of the cost of the basic service and is in addition to such cost.

The tipping guide 20 may be integrated or printed onto the front 12 of the check and guide 10, although, as size is limited on the front 12 of the check due to at least the display of the total 16, it is preferable to have the guide on the back 18 where more space is available.

The tipping guide 20 may be printed, glued, xerographed, or integrated through other means onto the back 18 of the check and guide 10 either before, during, or after the check portion 14 is printed. It is critical, however, that the tipping guide 20 be integrated to the check and guide 10 prior to providing the check and guide 10 to the customer for payment. The advantage of the integration of the tipping guide 20 is that the customer can quickly ascertain a percentage tip versus the total 16 for the services, without having to resort to mathematical calculation.

It is more economical to have the tipping guide 20 preprinted onto the back 18 of the check and guide 10 prior to printing the total 16 on the check portion 14 as the preprinted check and guide 10 can be simply stored until needed. However, there is an advantage to having the capability of printing or integrating the tipping guide 20 concurrently with the total 16, as the amounts on the tipping guide 20 can be instantly manipulated to reflect different currencies. Otherwise, separate check and guides 10 must be printed with tipping guides 20 reflecting different currencies.

Figure 3:
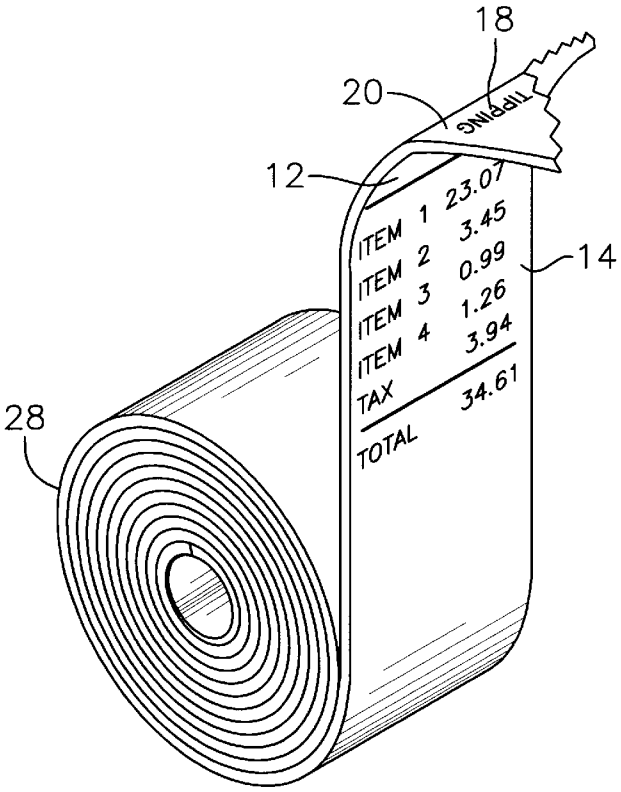
FIG. 3 is a perspective view of a roll tape with the service check on the front and a tipping guide integrated onto the back.
Figure 5:
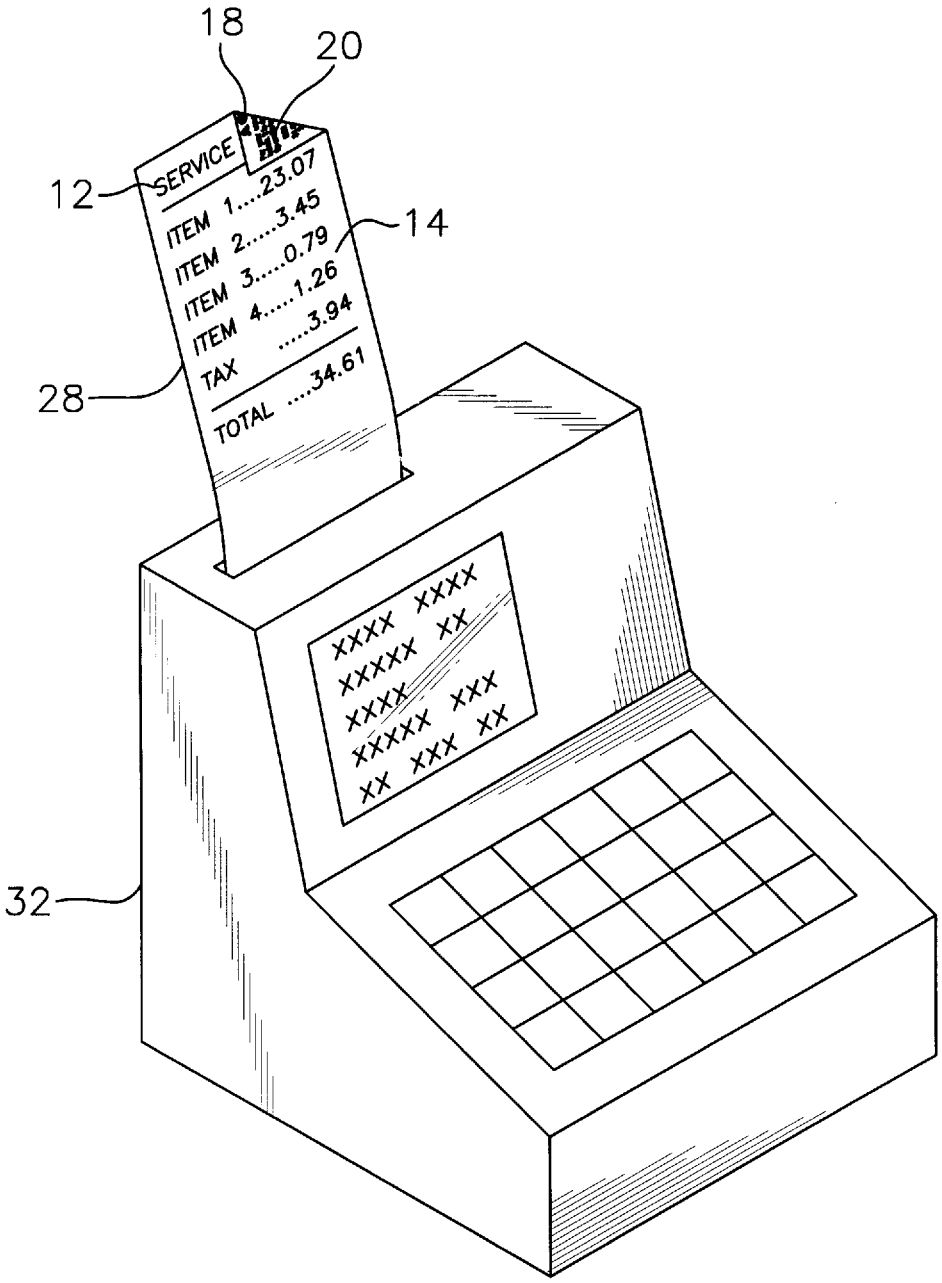
FIG. 5 is a perspective view of a cash register emitting the roll tape of FIG. 3.

Another embodiment of the present invention is shown in FIG. 3. The check and guide 10 is provided upon a continuous roll tape 28, normally used in cash registers 32, as shown in FIG. 5. The roll tape 28 is shown as having the check portion 14 printed on the front 12, and the tipping guide 20 printed on the back 18. The roll tape is preferably one which is 3 inches across, although other dimensions may be used.

The roll tape 28 is normally dislodged from the cash register 32 through serrations about the emitting opening for the roll tape 28, which is the most economical way of usage of the tape roll 28. Alternatively, the roll tape 28 could be perforated at various intervals throughout its length which would insure that one intact tipping guide 20 will be present on each separated check and guide 10.

As shown in FIG. 4, the tipping guide 20 can be preprinted and repeated throughout the length of the roll tape 28. As long as the length 30 of the tipping guide 20 is identical to the length of a printing on the check portion 14 of at least the purchase of a single item, the customer will have a full tipping guide 20 on the back of the check and guide 10, and can make usage thereof. Preprinting of the tipping guide 28 on the roll tape 28 is also more economical as the user need only insert the roll tape 28 into any register 32 as simply as regular roll tape.

Alternatively, the tipping guide could be printed or integrated on the back 18 or front 12 of the check and tipping guide 10 during printing of the check portion 14. While such capability allows instant manipulation of the tipping guide 20 to reflect other currencies, it is less economical because the user requires more complex equipment to perform this function.

While there has been shown a preferred and alternate embodiments of the present invention, it is to be understood that certain changes may be made in the form and arrangement of the elements of without departing from the underlying spirit of the invention as particularly set forth in claims.

What is claimed is:

1. A combined service check and tipping guide comprising:

a check for use at establishments who charge for services rendered for which a tip is anticipated;

the check having a front and a back;

the check further including an integrated tipping guide printed on the back of said check; and the tipping guide further comprised of a numeric table delineating the amount of a tip as a percentage of an amount owed in a predetermined ranges, wherein the specific monetary amount for services rendered is printed on the front of the check.

2. The combined service check and tipping guide according to claim 1, wherein:

(a) the check includes a front and a back;

(b) the tipping guide is integrated onto the back of the check; and (c) the specific monetary amount for services rendered is printed on the front of the check.

3. The combined service check and tipping guide according to claim 1, wherein the check is a bill for restaurant services.

4. The combined service check and tipping guide according to claim 1, wherein the check is a continuous roll tape for a cash register.

5. A method of providing a combined service check and tipping guide to a customer, comprising:

(a) integrating a tipping guide comprised of a numeric table delineating the amount of a tip as a percentage of an amount owed in a predetermined range onto a preprinted check for use at establishments who charge for services rendered for which a tip is anticipated;

(b) printing a specific monetary amount for services rendered on the check prior to providing the check with integrated tipping guide to the customer.

6. The method of providing a combined service check and tipping guide according to claim 5, wherein the check is a bill for restaurant services.

7. The method of providing a combined service check and tipping guide according to claim 6, wherein:

(a) the check includes a front and a back;

(b) the tipping guide is integrated onto the back of the check; and (c) the specific monetary amount for services rendered is printed on the front of the check.

8. The method of providing a combined service check and tipping guide according to claim 7, wherein the check is a continuous roll tape for a cash register.

9. A method of providing a combined service check and tipping guide to a customer, comprising:

(a) printing a check to bill a customer for a specific monetary amount for services rendered for which a tip is anticipated; and (b) simultaneously integrating a tipping guide comprised of a numeric table delineating the amount of a tip as a percentage of an amount owed in a predetermined range prior to providing the check with integrated tipping guide to the customer.

10. The method of providing a combined service check and tipping guide according to claim 9, wherein the check is a bill for restaurant services.

11. The method of providing a combined service check and tipping guide according to claim 2, wherein:

(a) the check includes a front and a back;

(b) the specific monetary amount for services rendered is printed on the front of the check; and (c) the tipping guide is printed on the back of the check.

12. The method of providing a combined service check and tipping guide according to claim 11, wherein the check is a continuous roll tape being for a cash register.

* * * * *

UNITED STATES PATENT AND TRADEMARK OFFICE

CERTIFICATE OF CORRECTION

PATENT NO. : 5,887,903

DATED : March 30, 1999

INVENTOR(S) : John E. Schreadley

It is certified that error appears in the above-identified patent and that said Letters Patent is hereby corrected as shown below:

Col. 3, delete "claim 2", lines 42-48.

Col. 3, line 49, delete "3." and replace with --2.--.

Col. 4, line 1, delete "4." and replace with --3.--.

Col. 4, line 4, delete "5." and replace with --4.--.

Col. 4, line 14, delete "6." and replace with --5.--.

Col. 4, line 15, delete "5" and replace with --4--.

Col. 4, line 17, delete "7." and replace with --6.--.

Col. 4, line 18, delete "6" and replace with --5--.

Col. 4, line 24, delete "8." and replace with --7.--.

Col. 4, line 25, delete "7" and replace with --6--.

Col. 4, line 27, delete "9." and replace with --8.--.

Col. 4, line 37, delete "10." and replace with --9.--.

UNITED STATES PATENT AND TRADEMARK OFFICE

CERTIFICATE OF CORRECTION

PATENT NO. : 5,887,903

DATED : March 30,1999

INVENTOR(S) : John E. Schreadley

It is certified that error appears in the above-identified patent and that said Letters Patent is hereby corrected as shown below:

Col. 4, line 38, delete "9" and replace with --8--.

Col. 4, line 40, delete "11." and replace with --10.--.

Col. 4, line 41, delete "2" and replace with --8--.

Col. 4, line 46, delete "12." and replace with --11.--.

Col. 4, line 47, delete "11" and replace with --10--.

Signed and Sealed this

Third Day of August, 1999

*Attest:*

Q. TODD DICKINSON

*Attesting Officer*

*Acting Commissioner of Patents and Trademarks*